United States Patent [19]

Wachter

[11] Patent Number: 5,072,786

[45] Date of Patent: Dec. 17, 1991

[54] ANTI-VIBRATION SUPPORT OF U-BEND FLOW TUBES IN A NUCLEAR STEAM GENERATOR

[75] Inventor: Willliam J. Wachter, Wexford, Pa.

[73] Assignee: Electric Power Research Institute, Inc., Palo Alto, Calif.

[21] Appl. No.: 558,591

[22] Filed: Jul. 27, 1990

[51] Int. Cl.[5] ..... F28F 7/00; F28D 7/16

[52] U.S. Cl. ..... 165/69; 165/162

[58] Field of Search ..... 165/69, 162, 172

[56] References Cited

U.S. PATENT DOCUMENTS

| | | | |
|---|---|---|---|
| 3,789,184 | 1/1974 | Piepers et al. | 165/69 |
| 3,929,569 | 12/1975 | Piepers et al. | 165/69 |
| 4,010,796 | 3/1977 | Scholtus | 165/162 |
| 4,105,067 | 8/1978 | Bovagne | 165/162 |
| 4,570,703 | 2/1986 | Ringsmuth et al. | 165/162 |
| 4,839,951 | 6/1989 | Boula et al. | 165/69 |
| 4,860,697 | 8/1989 | Malaval | 165/69 |

FOREIGN PATENT DOCUMENTS

| | | | |
|---|---|---|---|
| 764866 | 1/1957 | United Kingdom | 165/162 |

*Primary Examiner*—John Rivell
*Assistant Examiner*—L. R. Leo
*Attorney, Agent, or Firm*—Leonard Bloom

[57] ABSTRACT

An apparatus and a method for eliminating the gap between a flow tube and a respective support in a U-bend of a nuclear steam generator whereby the flow tube is disposed in the correct position and whereby fretting, corrosion and vibration are substantially eliminated. Support bars are provided between the columns of tubes, and each support bar carries a plurality of springs. Each spring resiliently engages a respective tube thereby eliminating the gap between the tube and the respective support. Each spring further has an elastic constant which is larger than the bending elastic constant of the tube, and the spring flexibly accommodates deformation during insertion of the support bar thereby assuring ease of installation.

12 Claims, 4 Drawing Sheets

ANTI-VIBRATION SUPPORT OF U-BEND FLOW TUBES IN A NUCLEAR STEAM GENERATOR

BACKGROUND OF THE INVENTION

1. Field of the Invention

The invention relates to the field of steam generators for nuclear power plants and in particular to apparatus for providing resilient support of flow tubes in the U-bend of the tube bundle in a nuclear power steam generator, thereby eliminating gaps between the tubes and the supports and substantially reducing vibration of the tubes due to the motion of fluids.

2. Description of the Prior Art

In a commercial nuclear power plant, thermal energy from the nuclear reactor is carried by the reactor coolant to a heat exchanger in which the delivered heat converts the feedwater into steam. The steam drives the turbine which converts the thermodynamic power into mechanical power. A mechanical coupling between the turbine and a generator delivers mechanical power to a generator which converts mechanical power into electric power.

In the heat exchanger, the reactor coolant flows through a bundle of flow tubes. The bundle has a straight portion followed by a 180 degree "U-turn" after which there is a second straight portion to the manifold which gathers the reactor coolant for return to the reactor for reheating.

In order to maximize the heat flow from the reactor coolant to the working fluid of the steam generator, a large number of small diameter thin wall tubes are contained in the bundle, and the spacing between the tubes assures good heat transfer. Each flow tube is readily set into vibration by the motions of steam and water. Such vibration, if unrestrained, will lead to the destruction of the tube. Consequently, anti-vibration bars have been introduced in the prior art.

The vibration problem is particularly acute in the U-bend of the flow tubes. The anti-vibration bar of the prior art comprises a bar bent into a V-shaped configuration such that two legs are formed with an angle between. The V-shaped anti-vibration bars are inserted between successive columns of the steam generator flow tubes. The ends of the V-shaped anti-vibration bars are connected to the respective ends of bars inserted into the adjacent gaps between columns of tubes. These anti-vibration bars limit the excursion of vibrations, but since there is at least a clearance gap between the bar and every flow tube, a vibration and rattle occurs as the flow tube is driven by the motion of steam and water around it. The result is a fretting and corrosion of flow tubes which leads to subsequent failure and expensive repair.

U.S. Pat. No. 4,285,396 issued to F. Schwoerer on Aug. 25, 1981 and assigned to Wachter Associates, Inc. discloses spring collar devices positioned at intervals along the tubes which permit lateral movement of the tubes but prevent any relative movement between the tube and its associated spring collar device. Any lateral movement is between the adjacent spring collar devices. With this arrangement fretting and corrosion between the outer surfaces of the tubes and their lateral support members are substantially eliminated. This system is for new nuclear steam generators.

U.S. Pat. No. 4,337,827 issued to F. S. Jabsen on July 6, 1982 and assigned to Babcott & Wilcox Company, discloses a support for a helically coiled fluid heat exchanger. In this heat exchanger flow tubes are bent in helical shapes and adjacent turns of the helix are nested in a plurality of support members. Pairs of tubes are nested between support members against a support strip, a spring is placed over the tubes and a second strip and is pressed on the assembly to the desired spring pressure and affixed. The method of vibration elimination of invention '827 is not applicable to standard nuclear steam generator flow tube geometries.

U.S. Pat. No. 4,747,372 issued to R. M. Wepfer et al on May 31, 1988 and assigned to Westinghouse Electric Corp. discloses an apparatus for minimizing the gaps between anti-vibration bars and the flow tubes in the U-bend section of a nuclear steam generator. Anti-vibration bars are provided between columns of flow tubes in the U-bend region and these bars are contoured on one side to correspond to the exact as built and as bent diameter of the tubes as located within the tube bundle. Such custom fitting of tube anti-vibration bars to actual tube size reduces the gap between anti-vibration bar and tube, but the fitting does not completely eliminate such gaps.

There still exists a need for a better apparatus and method for eliminating the gaps between flow tubes and support bars, for minimizing the vibration of flow tubes and for substantially eliminating the fretting and corrosion of flow tubes due to the action of fluids in a heat exchanger.

Accordingly, one object of the present invention is to provide an apparatus and a method which eliminates gaps between tubes and support bars and thereby precludes a rattling vibration. Another object is to resiliently but firmly support the flow tubes in the correct position in the nuclear steam generator. A further object of the invention is to provide a means of gap elimination and vibration reduction which is convenient to install in both existing and new nuclear power steam generators and is a means which is cost effective.

SUMMARY OF THE INVENTION

The present invention substantially eliminates vibration, fretting and corrosion of flow tubes in the U-bend section of the tube bundle in a steam generator. In accordance with the teachings of the present invention, there is herein and described an apparatus for the support and spacing of flow tubes in the U-bend of a steam generator having a plurality of flow tubes disposed in a regular pattern of columns of tubes with a space between the columns. Each tube has a first straight portion, a U-bend and a second straight portion. The semicircular segments of flow tube in the U-bend are flexible and without support are unable to maintain position with an acceptably small amplitude of vibration. A plurality of support bars are inserted between the flow tubes columns to provide substantially rigid support and control spacing. Each bar, having a clearance gap with respect to the column of tubes on each side, has a plurality of hairpin springs secured to the bar and disposed at positions to resiliently engage the flow tubes in the columns on both sides of the bar. The springs are characterized by spring constant $K_s$ and the tubes flexure elasticity is characterized by a spring constant $K_t$. A value of the spring constant $K_s$ which is five times the tube elastic flexure constant $K_t$ reduces vibration to an acceptable value, eliminates fretting and corrosion due to gaps between tube and support and facilitates convenient installation by elastic accommodation as needed during insertion of the bar.

A substantial number of existing nuclear power plants have steam generators which contain tube bundles geometrically organized in orderly columns. Prior art solutions to the problems of vibration, corrosion and fretting have not been completely satisfactory. The embodiment of the present invention in an existing steam generator will substantially reduce the vibration, corrosion and fretting of flow tubes in the U-bend section thereby reducing the maintenance cost in the production of electric power.

The present invention further teaches a method of manufacture of the plurality of support bars with the respective plurality of springs which resiliently engage the flow tubes. The substantially rigid strength member is a rectangular cross-section bar which fits with clearance between columns of tubes. The hairpin springs for disposition along the bar at the proper locations to engage flow tubes are manufactured by stamping both the hairpin springs and the spacing stem as one integral piece. The hairpin springs are formed by folding the legs of the spring together forming a bight in both the spring and the stem between springs. The spring assembly is then clipped onto the support bars so that the spring legs straddle the support bar and the bight wraps around one edge of the support bar. A bow is bent in each leg of each spring to provide the necessary spring for resiliently engaging the flow tubes. The end of the leg is secured to the bar by spot welding. The method of manufacture is a simple and cost effective process for providing a means for the reduction of vibration, fretting and corrosion of flow tubes in the U-bend section of existing and new steam generators.

BRIEF DESCRIPTION OF THE DRAWINGS

FIG. 5 is section 5—5 of FIG. 4.

FIG. 6 is section 6—6 of FIG. 4.

DESCRIPTION OF THE PREFERRED EMBODIMENTS

Figure 1:
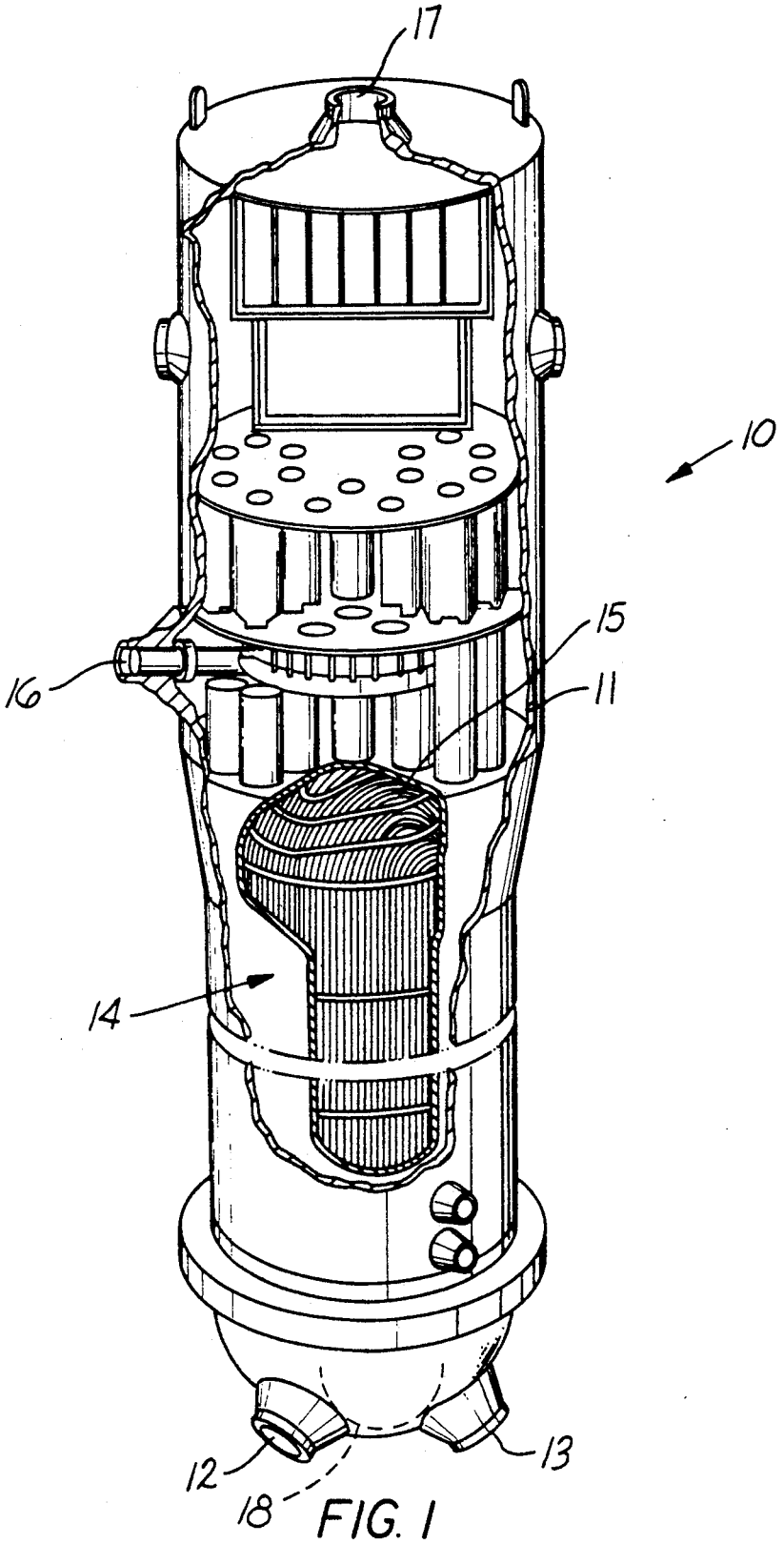
FIG. 1 is a perspective view, partially in cross section, of a nuclear steam generator having a U-bend section of the flow tube bundle for the embodiment of the present invention which substantially reduces vibration, corrosion and fretting.

Referring to FIG. 1, the operation of a nuclear power plant involves heating a coolant in a nuclear reactor (not shown) and transporting the hot coolant to a heat exchanger wherein water is heated to form steam. The steam generator 10 is enclosed in a pressure vessel, the wall 11 of which is shown in cross section. Hot coolant from the reactor enters inlet 12 and is distributed among the tubes of the bundle 14 rises up through the straight section, makes the U-turn 15 and then returns in a second straight segment to the coolant return manifold separated from the inlet manifold by partition 18. The coolant is then delivered back to the reactor for reheating via outlet port 13. Feed water for the production of steam is introduced at inlet 16. Water falling on the flow tube bundle is turned into steam, and, after a separation of water from the steam, the steam is delivered to the turbine through outlet 17.

Figure 2:
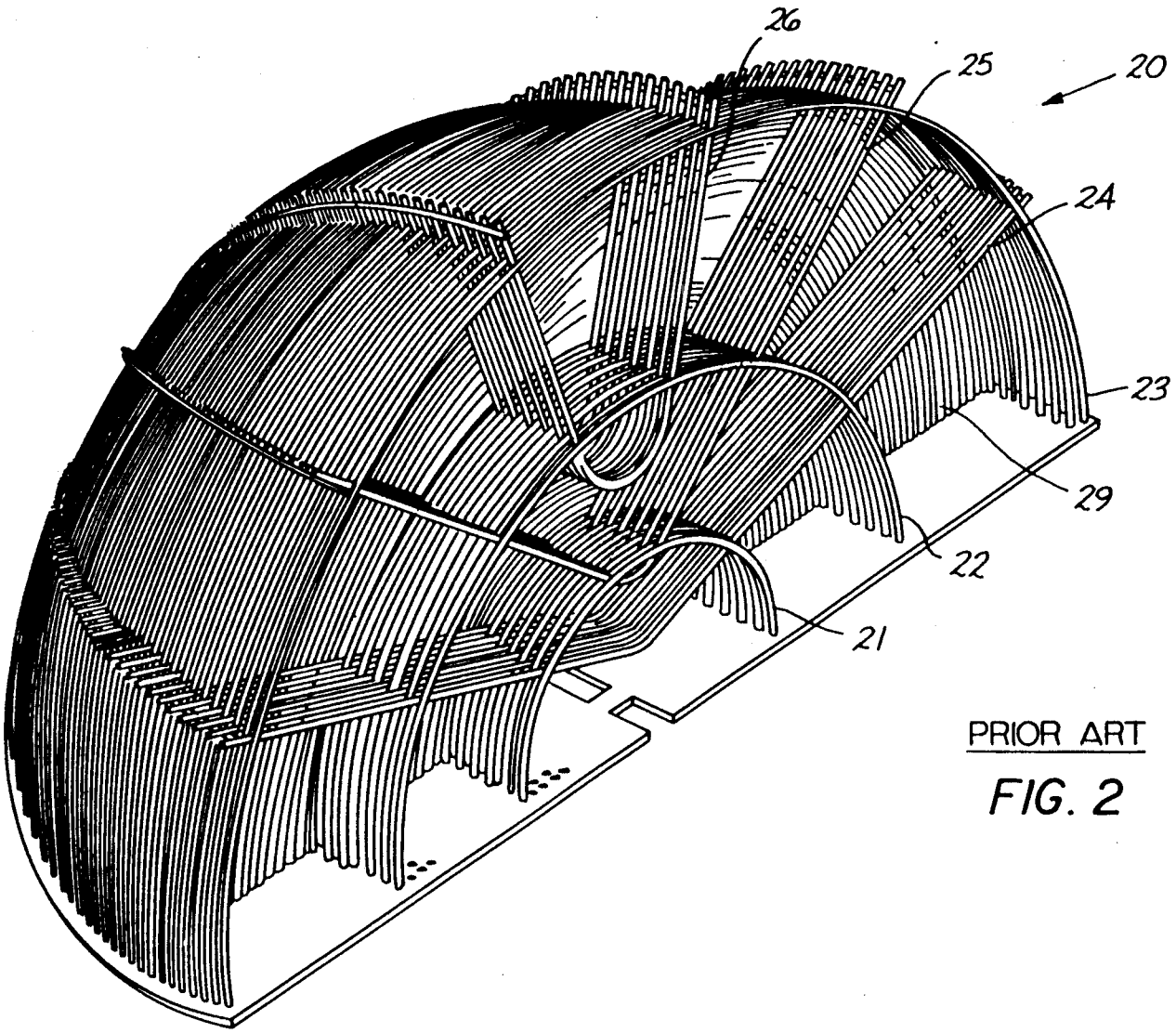
PRIOR ART FIG. 2
FIG. 2 is a schematic drawing of the U-bend section of the tube bundle showing only three ranks of semi-circular flow tube in order to clearly illustrate the prior art anti-vibration bars. The V-shaped anti-vibration bars are inserted between the columns of tubes, the spread of the V-shape becoming smaller for the higher vibration bars.

Referring to FIG. 2, the plurality of semi-circular segments of flow tube in the U-bend section of the tube bundle is shown. In FIG. 2, three ranks of flow tube 21, 22 and 23 are shown to illustrate the geometry of prior art solution to the vibration problem, namely the V-shaped anti-vibration bars 24, 25 and 26. In practice the density of tubes would preclude illustration of the prior art anti-vibration bar geometries, such close spacing of tubes is shown by the column of tubes labelled 29. While the prior art anti-vibration bars shown in FIG. 2 provide a restraint against vibration, the necessary clearance between the bar and the tube for installation leads to a rattling of the flow tube against the bar with a resulting fretting, corrosion and even mechanical fatigue due to persistent pounding. In the present invention a support bar is inserted between the columns of tubes, and according to the teaching of the present invention, the support bar exerts a resilient positioning and spacing force against each tube via a respective spring attached to the support bar.

Figure 3:
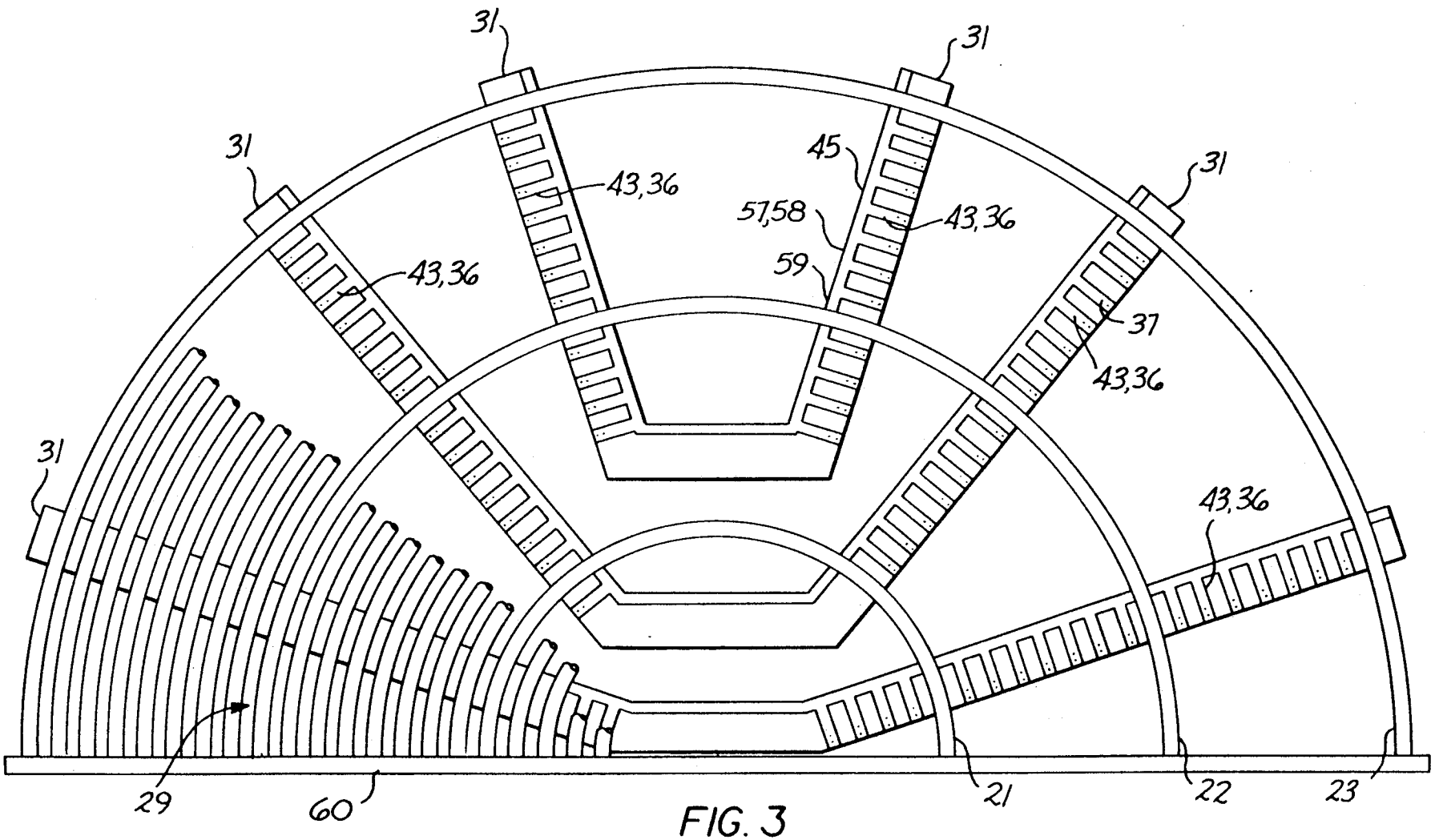
FIG. 3 schematically illustrates an embodiment of the invention in which support bars, each carrying a plurality of hairpin springs, are inserted between columns of flow tubes. Hairpin springs with bowed legs resiliently engage the flow tubes when the support bar is in the correct position.

Referring to FIG. 3, the embodiment of the invention 30 is a plurality of support bars 31 inserted between columns of flow tubes, column 29 is sectioned to show the bars. Mounted on each support bar is a series of bow-shaped springs 36, 43 which resiliently engage the flow tube on either side of the support bar and which are secured to the support bar by spot welding 37. The material and the design of the bow spring is selected such that the elastic constant of the bow spring $K_s$ is equal to five times the bending elastic constant for the tube $K_t$. With this relationship between the elastic constants, the flow tubes 29 are securely spaced and disposed, and at no time is there a gap between the flow tube and the support spring.

Figure 4:
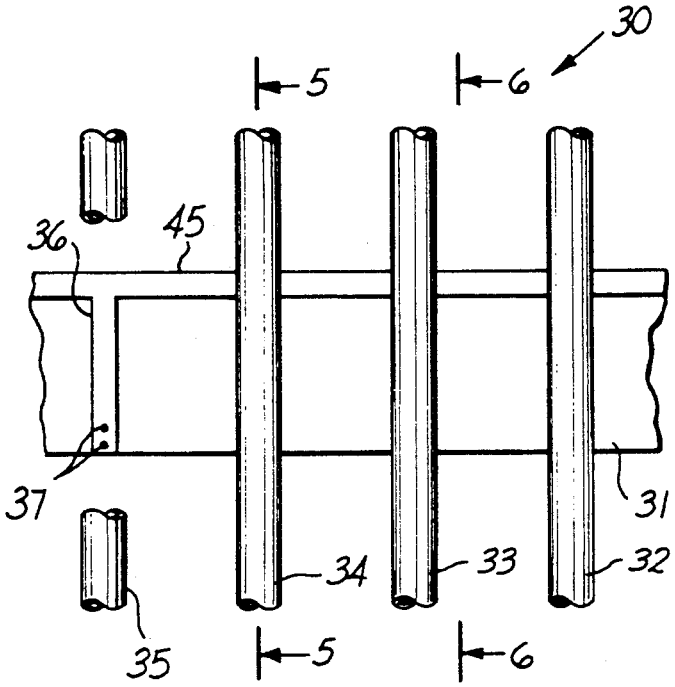
FIG. 4 shows one side of the support bar and sections of several flow tubes near the bar.

Referring to FIG. 4, the support bar 31, flow tubes 32-35 and the bow spring 36 are shown in more detail. The bight 45 forming the hairpin spring clips onto the edge of the support bar 31. The end of the bow spring leg of the hairpin is spot welded 37 to the bar 31.

Figure 5:
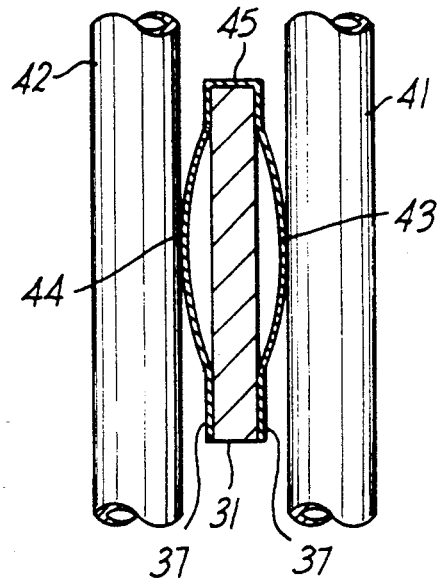
FIG. 5 schematically illustrates the hairpin spring with two legs bowed to resiliently engage flow tubes on either side of the support bar.

Referring to FIG. 5, a cross section through 5—5 of FIG. 4 is shown. Flow tubes 41 and 42 are resiliently engaged by bow springs 43 and 44, respectively. Each spring is formed by shaping a bow in a leg of a hairpin spring which straddles the support bar 31. The legs of the hairpin spring are spot welded 37 to the support bar 31. The hairpin springs are formed by bending an appropriately stamped piece of sheet spring stock to form a bight 45 around one edge of the support bar 31.

Figure 6:
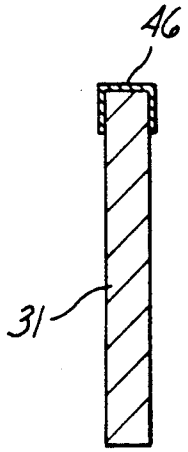
FIG. 6 is a schematic cross section of the support bar between hairpin springs showing how the bight in the stem clips onto one edge of the bar.

Referring to FIG. 6, which is section 6—6 of FIG. 4, the stem portion 46, 59 which carries and spaces the hairpin springs is clipped to one edge of the support bar between hairpin springs.

Figure 7:
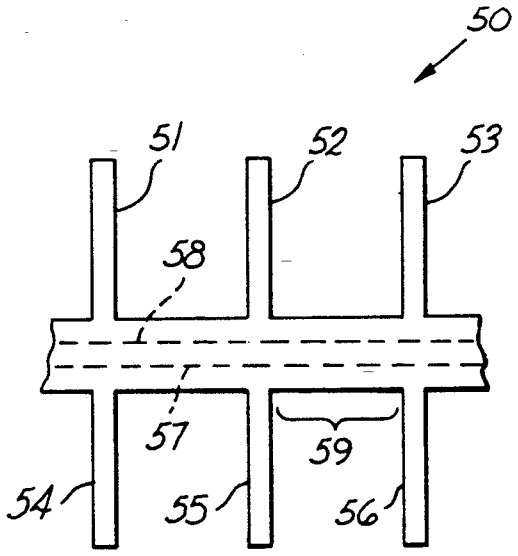
FIG. 7 schematically illustrates the manufacture of the springs and spacer stem between springs. Hairpin springs and stems between springs are stamped as one integral piece from sheet metal. The piece is folded 90 degrees along the two dashed lines and clipped on the support bar so that the legs straddle the bar as illustrated in FIG. 5.

Referring to FIG. 7, the hairpin springs 51-56 and the spacer stem 59 between them are stamped from sheet spring stock to form an integral unit 50. The lateral portions of the stamping 51-56 form the respective pairs of legs of hairpin springs. The unit is fabricated by folding a 90 degree bend along the two dashed lines 57 and 58. The spring legs 51-56 are further bent to form a bow prior to securing the ends of the legs by spot welding 37 as shown in FIGS. 3, 4 and 5. The stem 59 disposes the springs at the appropriate position to engage the flow tube on either side of the support bar.

What is claimed is:

1. In a heat exchanger having a plurality of spaced-apart tubes and further having at least one support bar disposed intermediately of the respective tubes, the improvement in reducing vibration of the tubes against the support bar, comprising a plurality of hairpin springs carried by the support bar, the hairpin springs being substantially parallel to each other and spaced-apart from each other, each of the hairpin springs including a bight portion and further including a pair of legs, each of the legs having an end portion secured to the support bar, and further having a bowed portion intermediately of the end portion and the bight portion, respectively, and each bowed portion resiliently engaging a respective tube, thereby substantially eliminating the vibration of the tubes in the heat exchanger.

2. The improvement of claim 1, further including a central longitudinal stem to which the respective bight portions of the plurality of hairpin springs are joined, and the support bar having a longitudinal edge disposed adjacent to the central longitudinal stem.

3. The improvement of claim 1, further comprising a plurality of support bars, such that a respective support bar is disposed between a pair of tubes, including a first tube and a second tube, each of the tubes having a spring constant defined as $H_t$, a first spring carried by the support bar and resilient engaging the first tube, a second spring carried by the support bar resiliently engaging the second tube, each spring having a substantially equal spring constant defined as $K_s$, and the spring constant $K_s$ of the springs being substantially greater than the spring constant $K_t$ of the tubes, thereby spacing the tubes apart and substantially precluding vibration of the tubes.

4. The improvement of claim 3, wherein $$K_s = 5\ K_t$$

5. The improvement of claim 3, wherein the first and second spring each has a maximum elastic deflection which exceeds the deformation necessary during installation by insertion between the first and second tubes of the support bar carrying the first and second springs, thereby assuring a resilient engagement of the first and second tubes, respectively, and ease of assembly.

6. The improvement of claim 1, wherein the plurality of hairpin springs carried by said support bar is fabricated from one piece of sheet metal by stamping a long narrow stem and further stamping pairs of legs extending substantially perpendicular to the stem, by folding the stem to form the hairpin bight where pairs of legs join and an integral stiff channeled spacer between pairs of legs, by bending each leg to form a bow-shaped spring which is bowed outward from the support bar, and by securing the other ends of the legs to the support bar by, for example, spot welding.

7. In a heat exchanger having a plurality of spaced-apart tubes and further having at least one support bar disposed intermediately of the respective tubes, the improvement in reducing vibration of the tubes against the support bar, comprising a plurality of pairs of bifurcated legs having respective end portions and being joined together at a common bight portion, the bight portion being secured to the bar, and wherein each end portion resiliently engages a first tube and a second tube respectively, thereby substantially precluding vibration of the tubes.

8. The improvement of claim 7, wherein the maximum elastic deflection of the spring legs exceeds the deformation during installation whereby assuring a resilient engagement of the first and second spring with the first and second tubes respectively, and ease of assembly.

9. An apparatus for supporting a flow tube in the U-bend of a bundle of tubes in a heat exchanger, wherein the flow tube has a spring constant $K_t$ and further has a pair of substantially diametrically-opposed sides, and wherein a pair of support bars including a first bar and a second bar is provided, such that the tube is disposed between the first and second bars, comprising a first spring carried by the first bar and resiliently engaging one side of the tube, a second spring carried by the second bar and resiliently engaging the other side of the tube, the springs having a substantially equal spring constant defined as $K_s$, and the spring constant $K_s$ of the springs being substantially greater than the spring constant of $K_t$ of the tube, such that the tube is supported and substantially prevented from vibrating, and further comprising a plurality of hairpin springs, each hairpin spring having two legs, each leg having a bight, a middle and end portions, wherein the first and second springs carried by the first and second support bars are each a bowed middle portion of a hairpin spring leg, the end portion being secured to the support bar and the bight portion straddles the edge of the support bar.

10. The apparatus of claim 9, wherein $$K_s = \mathbf{b}\ Kt.$$

11. An apparatus for supporting a flow tube in the U-bend of a bundle of tubes in a heat exchanger, wherein the flow tube has a spring constant $K_t$ and further has a pair of substantially diametrically-opposed sides, and wherein a pair of support bars including a first bar and a second bar is provided, such that the tube is disposed between the first and second bars, comprising a first spring carried by the first bar and resiliently engaging one side of the tube, a second spring carried by the second bar and resiliently engaging the other side of the tube, the springs having a substantially equal spring constant defined as $K_s$, and the spring constant $K_s$ of the springs being substantially greater than the spring constant of $K_t$ of the tube, such that the tube is supported and substantially prevented from vibrating, and wherein the first and second springs carried by the first and second support bars respectively are each one leg of a pair of bifurcated legs joined together at a common bight, and the bight portion is secured to the respective bar.

12. The method of assembling a substantially vibration-free support for flow tubes in the U-bend of a heat exchanger comprising the steps of providing a plurality of spaced-apart flow tubes, providing a plurality of support bars, providing springs disposed on and secured to the support bars, providing springs disposed on and secured to the support bars, each spring having a pair of bifurcated legs exerting a resilient force on its respective flow tube which eliminates any clearance gap and substantially precludes vibration, inserting the support bars carrying the springs between columns of tubes, flexing each spring as it encounters each tube before reaching the installed position, and securing the support bar in position once each spring is resiliently engaging the correct flow tube.

* * * * *